US011808505B2

(12) United States Patent
Farrel et al.

(10) Patent No.: US 11,808,505 B2
(45) Date of Patent: Nov. 7, 2023

(54) MACHINE READABLE ICE CUBE MOLD AND MAKER

(71) Applicant: Haier US Appliance Solutions, Inc., Wilmington, DE (US)

(72) Inventors: Caleb Farrel, Jeffersonville, IN (US); Todd Charles Hansen, Shelbyville, KY (US); Joshua Adam Mayne, Charlestown, IN (US); Daniel Ian Moore, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 21 days.

(21) Appl. No.: 17/502,148

(22) Filed: Oct. 15, 2021

(65) Prior Publication Data

US 2023/0123970 A1 Apr. 20, 2023

(51) Int. Cl.
*F25C 1/04* (2018.01)
*F25C 1/24* (2018.01)
*F25C 1/25* (2018.01)

(52) U.S. Cl.
CPC ..... *F25C 1/04* (2013.01); *F25C 1/24* (2013.01); *F25C 1/25* (2018.01); *F25C 2400/06* (2013.01); *F25C 2400/14* (2013.01); *F25C 2600/04* (2013.01); *F25C 2700/12* (2013.01)

(58) Field of Classification Search
CPC ..... F25C 1/04; F25C 1/24; F25C 1/25; F25C 2400/06; F25C 2400/14; F25C 2600/04; F25C 2700/12; F25C 2600/00; F25C 1/00
See application file for complete search history.

(56) References Cited

U.S. PATENT DOCUMENTS 9,074,802 B2 7/2015 Culley et al.
2019/0360736 A1* 11/2019 DePlessis et al. .. F25C 2700/12

FOREIGN PATENT DOCUMENTS

CN 107667267 A * 2/2018 ..... F25C 2700/12
JP 2006266511 A 10/2006
JP 2006336962 A 12/2006
JP 2010276210 A * 12/2010 ..... F25C 1/10
JP 2010276210 A 12/2010
WO WO2020059585 A1 3/2020

OTHER PUBLICATIONS

CN 107667267 A Translation (Year: 2018).*
JP 2010276210 A Translation (Year: 2010).*

* cited by examiner

*Primary Examiner* — Elizabeth J Martin
*Assistant Examiner* — Dario Antonio Deleon
(74) *Attorney, Agent, or Firm* — Dority & Manning, P.A.

(57) ABSTRACT

Ice making appliances and methods for making ice using a machine-readable ice cube mold are provided herein. The ice making appliances and methods of making ice may include obtaining ice mold identifier data from the ice mold. Ice mold identifier may be used to acquire operating parameters of the ice making appliance specific to that ice mold from an external communication network. The operating parameters may be used to adjust operation of the appliance, such as the volume of water to dispense for that particular mold.

20 Claims, 7 Drawing Sheets

MACHINE READABLE ICE CUBE MOLD AND MAKER

FIELD OF THE INVENTION

The present subject matter relates generally to ice making appliances and methods, and more particularly to appliances and methods for making shaped ice using custom molds automatically.

BACKGROUND OF THE INVENTION

In domestic and commercial applications, ice is often formed as solid cubes. An ice maker can receive liquid water, and such liquid water can freeze within the ice maker to form ice cubes. In particular, certain ice makers include a freezing mold that defines a plurality of cavities. The plurality of cavities can be filled with liquid water, and such liquid water can freeze within the plurality of cavities to form solid ice cubes. The shape of such cubes is dictated by the size and shape of the cavities in the ice mold.

A wide variety of custom ice molds exist that rely on this principle to enable consumers to create ice of varying sizes and pleasurable shapes that consumers may use for parties or other events. However, such molds typically require manual filling of the molds, which may have differing requirements regarding water volume, freezing time, etc. Particularly where a variety of mold shapes are desirable for a single event, automation of the filling process is hampered by the varying requirements of different molds. Furthermore, the length of time necessary to freeze the custom ice typically results in consumers leaving the ice mold to freeze overnight. As a result, the consumer has only a single mold's worth of ice, which may be insufficient for the volume of ice necessary at parties and the like. Multiple ice molds may be used simultaneously, but such an arrangement takes up valuable freezer space.

It would therefore be desirable to have an ice making appliance and methods that can recognize the ice mold employed in the appliance and adjust or otherwise tailor the operation of the appliance for the specific mold in use to automatically fill the ice molds and optimize the freezing process. It is further desirable to detect when ice formation is complete and to notify users to enable them to promptly begin further cycles as desired.

BRIEF DESCRIPTION OF THE INVENTION

Aspects and advantages of the invention will be set forth in part in the following description, or may be obvious from the description, or may be learned through practice of the invention.

In exemplary aspects of the present disclosure, an ice making appliance is provided. The ice making appliance may include a cabinet, a chilled chamber within the cabinet, a fluid dispenser within the chilled chamber, a valve in fluid communication with the fluid dispenser for controlling the flow of water to the fluid dispenser, a removable ice mold, a mold identifier reader, and a controller. The removable ice mold may be situated below the fluid dispenser. The removable ice mold may further include an ice mold identifier. The controller may be operably coupled to the valve, the mold identifier reader, and an external communication network. The controller may further be configured to obtain ice mold identifier data from the mold identifier reader, receive operating parameter data from the external communication network representing at least one operating parameter for use with the ice mold, and use the at least one operating parameter obtained from the external communication network to control operation of the valve.

In exemplary aspects of the present disclosure, a method of making ice using a custom ice mold having a mold identifier is provided. The method may include obtaining ice mold identifier data from the ice mold, receiving operating parameter data from an external communication network representing at least one operating parameter for use with the ice mold, and using the at least one operating parameter obtained from the external communication network to control operation of a valve.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
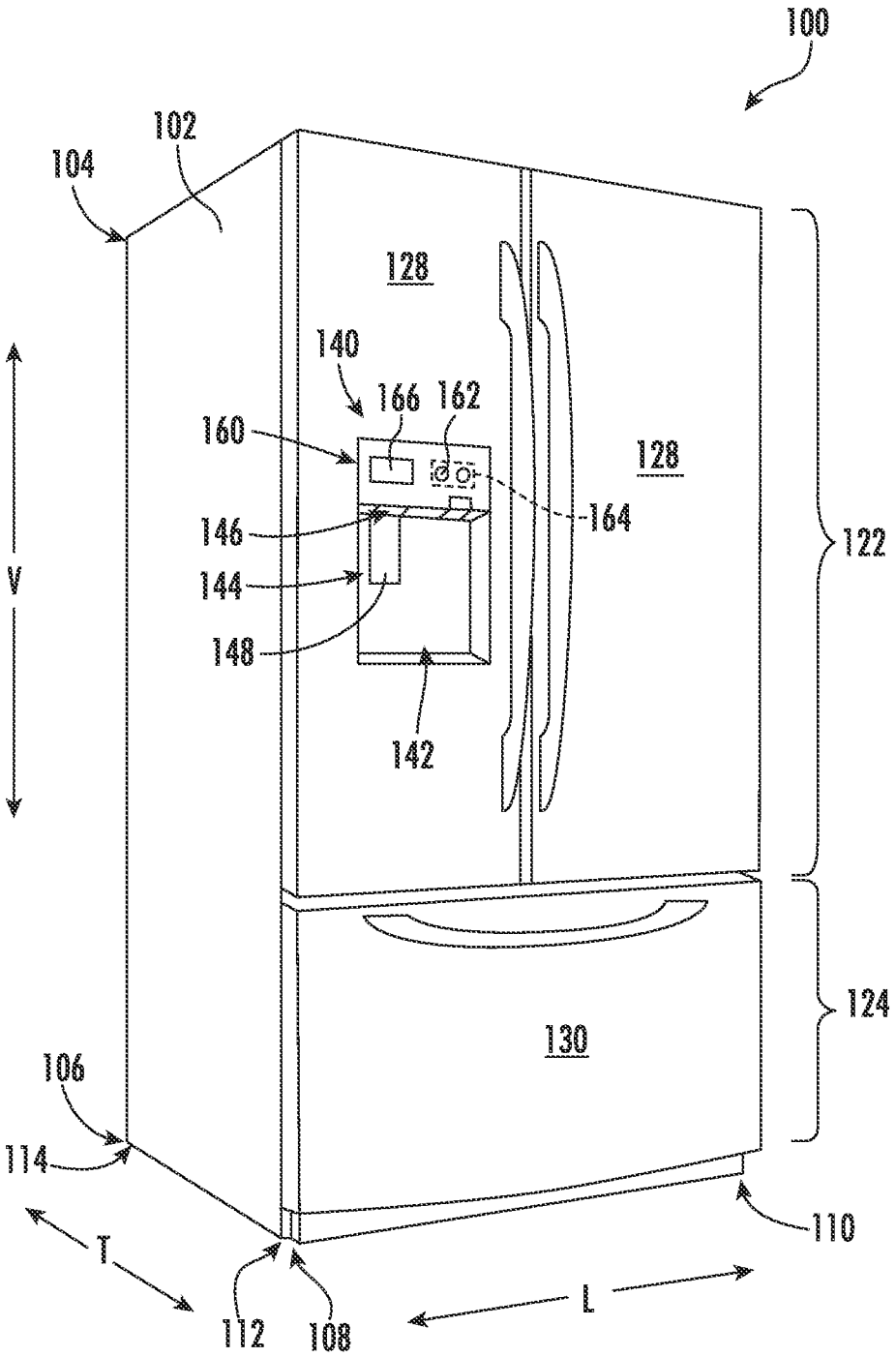
FIG. 1 provides a perspective view of an ice making appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

One or more examples of the present embodiments of the invention are illustrated in the accompanying drawings. The detailed description uses numerical and letter designations to refer to features in the drawings. Like or similar designations in the drawings and description have been used to refer to like or similar parts of the invention. As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "includes" and "including" are intended to be inclusive in a manner similar to the term "comprising." Similarly, the term "or" is generally intended to be inclusive (i.e., "A or B" is intended to mean "A or B or both").

FIG. 1 provides a perspective view of an ice making appliance 100 according to an exemplary embodiment of the present subject matter. Ice making appliance 100. Ice making appliance 100 may take several forms, including a refrigerator, a combination refrigerator and freezer, a stand-alone freezer appliance, a stand-alone ice maker and the like. Ice making appliance 100, as shown in the embodiment of FIG. 1, includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another.

Housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance, a side-by-side style refrigerator appliance, or a single door refrigerator appliance. Further, the present disclosure is not limited to refrigerator appliances, but may extend to stand-alone freezers or ice makers, as well. Consequently, the description set forth herein is for illustrative purposes only and is not intended to be limiting in any aspect to any particular refrigerator, freezer, or icemaker chamber configuration.

Refrigerator doors 128 are rotatably hinged to an edge of housing 102 for selectively accessing fresh food chamber 122 in the embodiment of FIG. 1. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1. One skilled in the art will appreciate that other chamber and door configurations are possible and within the scope of the present invention.

Figure 2:
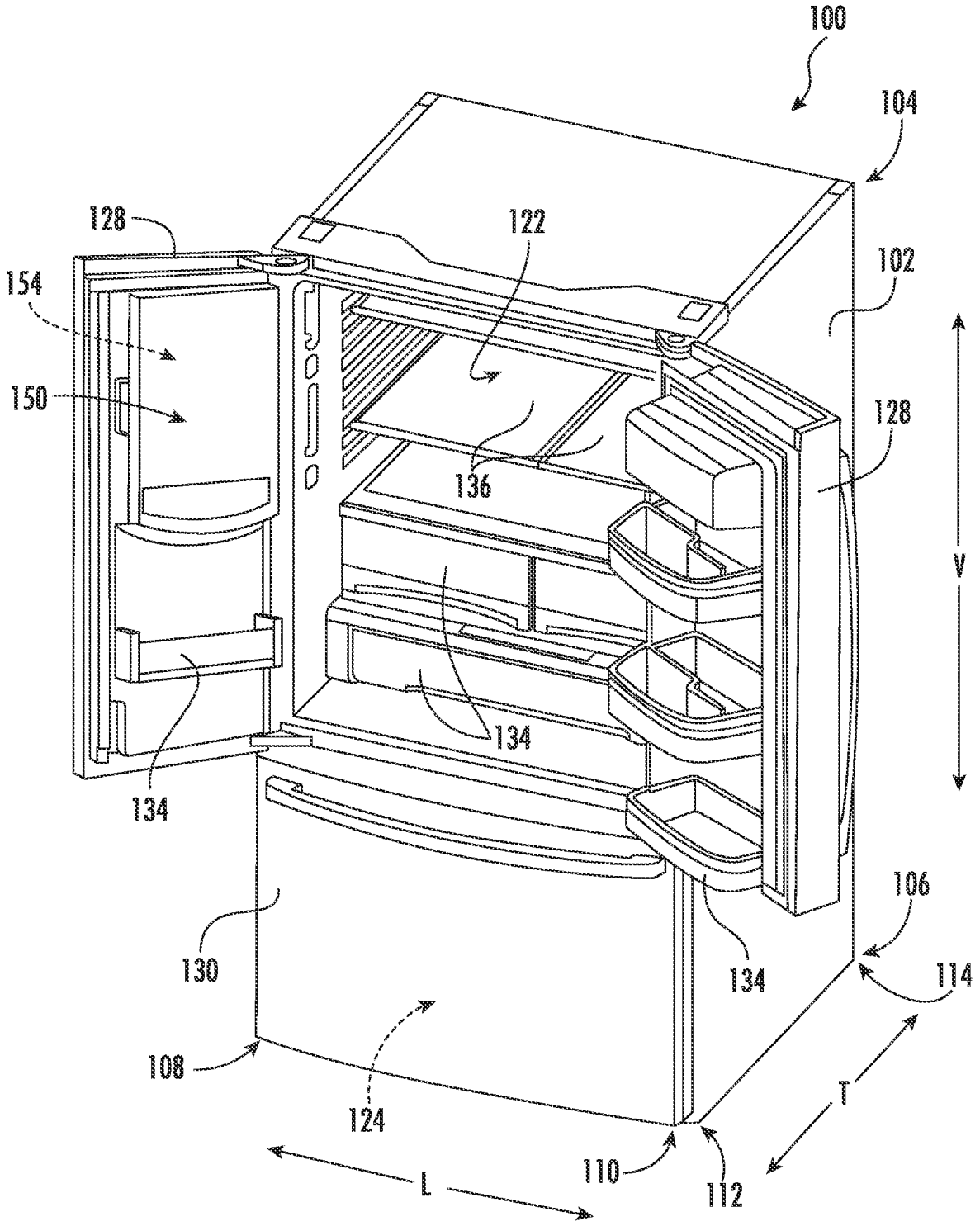
FIG. 2 provides a perspective view of an ice making appliance and an interior chamber of same according to exemplary embodiments of the present disclosure.

FIG. 2 provides a perspective view of refrigerator appliance 100 shown with refrigerator doors 128 in the open position. As shown in FIG. 2, various storage components are mounted within fresh food chamber 122 to facilitate storage of food items therein as will be understood by those skilled in the art. In particular, the storage components may include bins 134 and shelves 136. Each of these storage components are configured for receipt of food items (e.g., beverages and/or solid food items) and may assist with organizing such food items. As illustrated, bins 134 may be mounted on refrigerator doors 128 or may slide into a receiving space in fresh food chamber 122. It should be appreciated that the illustrated storage components are used only for the purpose of explanation and that other storage components may be used and may have different sizes, shapes, and configurations.

Referring now generally to FIG. 1, a dispensing assembly 140 will be described according to exemplary embodiments of the present subject matter. Dispensing assembly 140 is generally configured for dispensing liquid water and/or ice. Although an exemplary dispensing assembly 140 is illustrated and described herein, it should be appreciated that variations and modifications may be made to dispensing assembly 140 while remaining within the present subject matter.

Dispensing assembly 140 and its various components may be positioned at least in part within a dispenser recess 142 defined on one of refrigerator doors 128. In this regard, dispenser recess 142 is defined on a front side 112 of refrigerator appliance 100 such that a user may operate dispensing assembly 140 without opening refrigerator door 128. In addition, dispenser recess 142 is positioned at a predetermined elevation convenient for a user to access ice and enabling the user to access ice without the need to bend-over. In the exemplary embodiment, dispenser recess 142 is positioned at a level that approximates the chest level of a user.

Dispensing assembly 140 includes an ice dispenser 144 including a discharging outlet 146 for discharging ice from dispensing assembly 140. An actuating mechanism 148, shown as a paddle, is mounted below discharging outlet 146 for operating ice or water dispenser 144. In alternative exemplary embodiments, any suitable actuating mechanism may be used to operate ice dispenser 144. For example, ice dispenser 144 can include a sensor (such as an ultrasonic sensor) or a button rather than the paddle. Discharging outlet 146 and actuating mechanism 148 are an external part of ice dispenser 144 and are mounted in dispenser recess 142.

By contrast, inside refrigerator appliance 100, refrigerator door 128 may define an icebox 150 (FIGS. 2-3) housing an icemaker and an ice storage bin that are configured to supply ice to dispenser recess 142. In this regard, for example, icebox 150 may define an ice making chamber 154 for housing an ice making assembly, a storage mechanism, and a dispensing mechanism.

Figure 3:
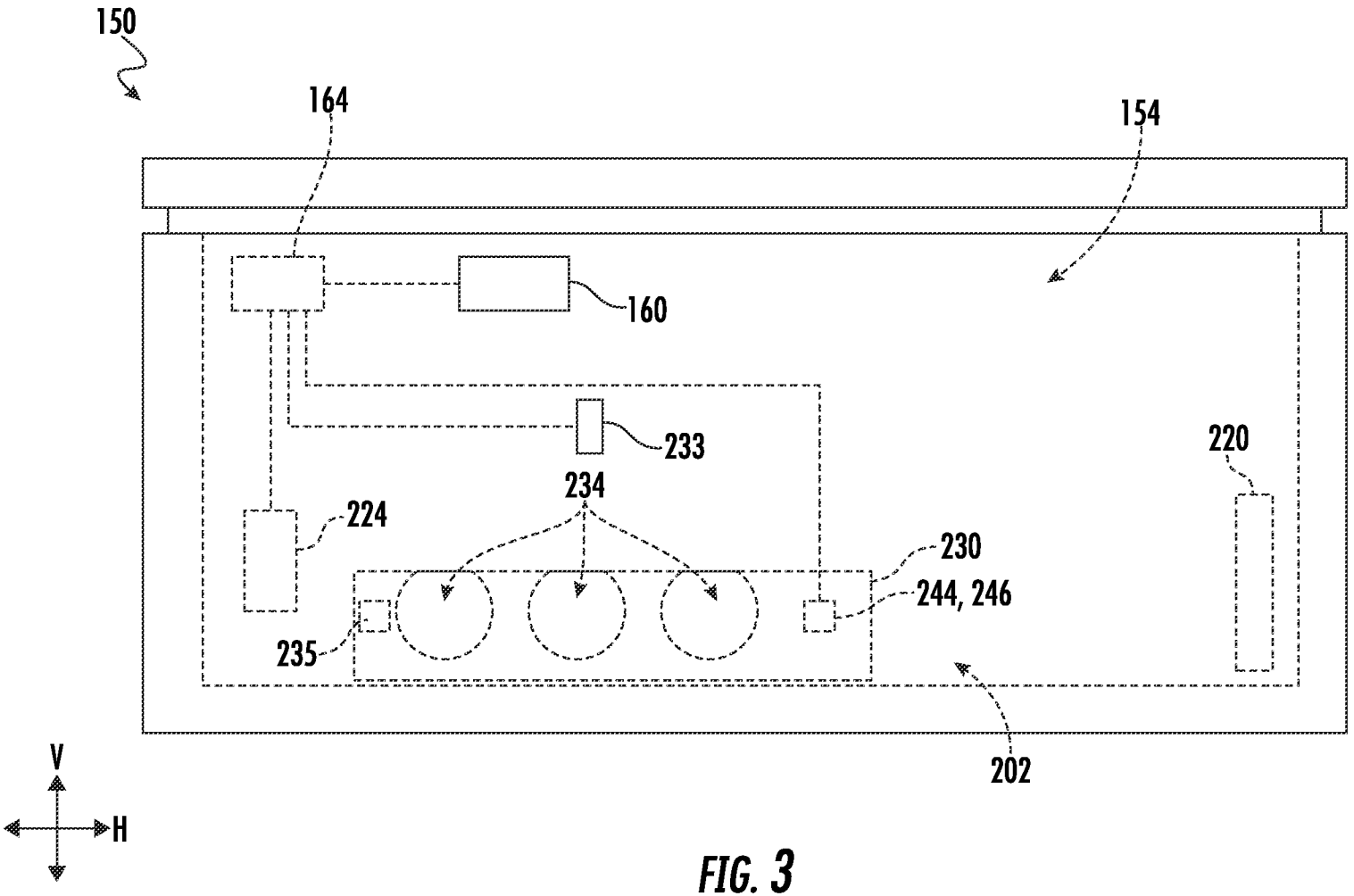
FIG. 3 provides a cross-sectional schematic view of a portion of an icebox according to exemplary embodiments of the present disclosure.
Figure 4:
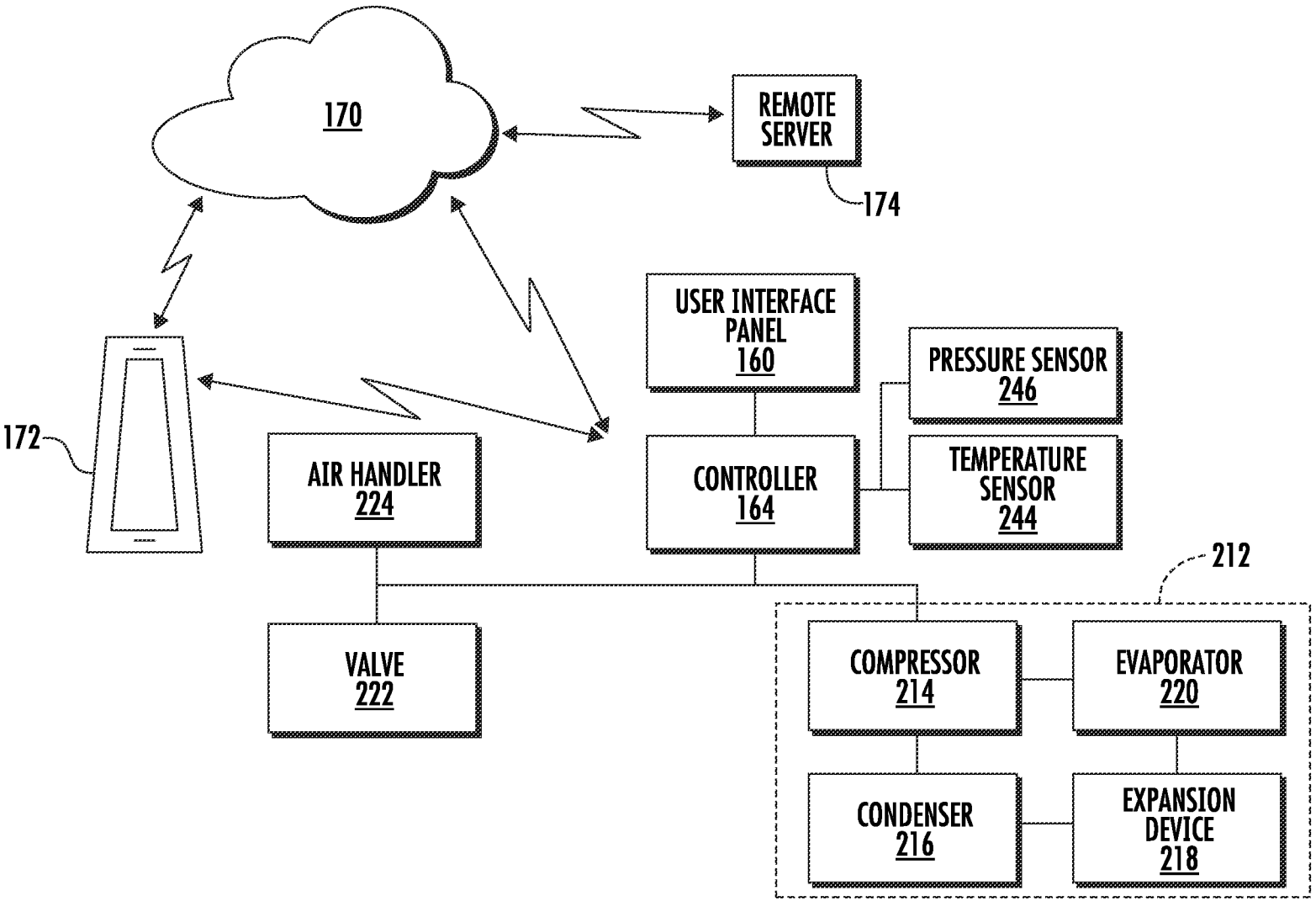
FIG. 4 provides a schematic view of elements of an ice making appliance with which a controller interfaces according to an example embodiment of the present disclosure.
Figure 5:
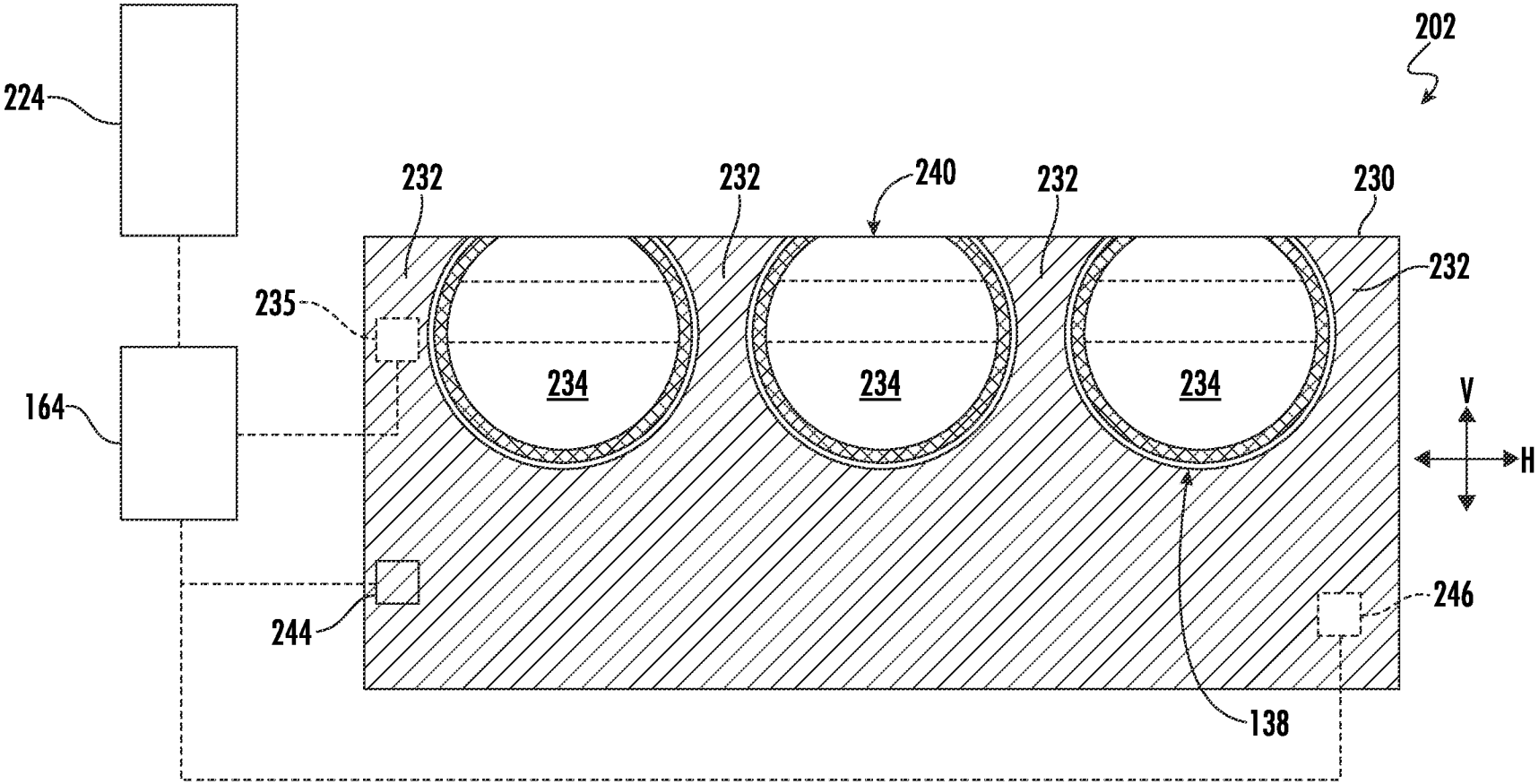
FIG. 5 provides a cross-sectional view of an ice mold according to exemplary embodiments of the present disclosure.

Turning now to the figures, FIG. 3 provides a side plan view of icebox 150 in ice making appliance 100, including an ice making assembly 202. FIG. 4 provides a schematic view of ice making assembly 202. FIG. 5 provides a cross-sectional schematic view of a portion of ice making assembly 202.

Generally, ice making appliance 100 defines one or more chilled chambers, such as a freezer chamber 124 and ice making chamber 154. FIG. 3 provides an illustrative view of the elements of icebox 150 in one exemplary embodiment. In the embodiment of FIG. 3, icebox 150 is understood to be formed as, or as part of, a refrigerator appliance. It is recognized, however, that the elements of FIG. 3 need not be contained within the ice making chamber 154 of icebox 150 but may alternatively be contained in freezer chamber 124 or any chilled chamber of ice making appliance 100. Moreover, additional or alternative embodiments may be provided within the context of other refrigeration appliances. For instance, the benefits of the present disclosure may apply to any type or style of a refrigerator appliance (e.g., a top mount refrigerator appliance, a bottom mount refrigerator appliance, a side-by-side style refrigerator appliance, etc.) that includes a freezer chamber, icebox, or other chilled chamber, wherein ice making may occur. Additionally, or alternatively, the present disclosure may apply to a stand-alone freezer or stand-alone ice maker. Consequently, the description set forth herein is for illustrative purposes only and is not intended to be limiting in any aspect to any particular chamber configuration.

Ice making appliance 100 generally includes an ice making assembly 202 on or within the chilled chamber (e.g., ice making chamber 154). In some embodiments, ice making appliance 100 includes a door (not pictured) that is movably attached to icebox 150. As would be understood, the door may selectively cover an opening defined by icebox 150. For instance, the door may rotate or slide between an open position, permitting access to ice making chamber 154, and a closed position, restricting access to ice making chamber 154.

A fluid delivery system (not pictured) delivers water from a residential or commercial water supply to ice making appliance 100, and specifically to the chilled chamber (e.g., ice making chamber 154). A fluid dispenser 233 is provided is provided, in the embodiment of FIG. 3, in the ice making chamber 154. The fluid delivery system provides water to fluid dispenser 233, where the water is introduced to the ice making chamber 154 to facilitate formation of ice, as further described herein.

As will be described in detail below, and as illustrated in FIG. 4, ice making appliance 100 includes a sealed cooling system 212 for executing a vapor compression cycle for cooling air within ice making appliance 100 (e.g., within freezer chamber 124 or ice making chamber 154). Sealed cooling system 212 includes a compressor 214, a condenser 216, an expansion device 218, and an evaporator 220 connected in fluid series and charged with a refrigerant. As will be understood by those skilled in the art, sealed cooling system 212 may include additional components (e.g., at least one additional evaporator, compressor, expansion device, or condenser). Moreover, at least one component (e.g., evaporator 220) is provided in thermal communication with freezer chamber 124 and/or ice making chamber 154 to cool the air or environment within those chambers.

Within sealed cooling system 212, gaseous refrigerant flows into compressor 214, which operates to increase the pressure of the refrigerant. This compression of the refrigerant raises its temperature, which is lowered by passing the gaseous refrigerant through condenser 216. Within condenser 216, heat exchange with ambient air takes place so as to cool the refrigerant and cause the refrigerant to condense to a liquid state.

Expansion device (e.g., a mechanical valve, capillary tube, electronic expansion valve, or other restriction device) 218 receives liquid refrigerant from condenser 216. From expansion device 218, the liquid refrigerant enters evaporator 220. Upon exiting expansion device 218 and entering evaporator 220, the liquid refrigerant drops in pressure and vaporizes. Due to the pressure drop and phase change of the refrigerant, evaporator 220 is cool relative to freezer chamber 124 (or, in alternative embodiments, ice making chamber 154). As such, cooled air is produced and refrigerates freezer chamber 124. Thus, evaporator 220 is a heat exchanger which transfers heat from air passing over evaporator 220 to refrigerant flowing through evaporator 220.

In certain embodiments, ice making appliance 100 also includes an air handler 224 mounted within (or otherwise in fluid communication with) freezer chamber 124. Air handler 224 may be operable to urge a flow of chilled air within freezer chamber 124. Moreover, air handler 224 can be any suitable device for moving air. For example, air handler 224 can be an axial fan or a centrifugal fan.

Optionally, ice making appliance 100 further includes a valve 222 for regulating a flow of liquid water to ice making assembly 102. Valve 222 may be situated upstream from and be in fluid communication with fluid dispenser 233. Valve 222 is selectively adjustable between an open configuration and a closed configuration. In the open configuration, valve 222 permits a flow of liquid water to ice making assembly 202. Conversely, in the closed configuration, valve 222 hinders the flow of liquid water to an ice mold 230. Valve 222 may be operably coupled to controller 164, which may control the state and timing for opening and closing valve 222, thereby controlling the flow of water to fluid dispenser 233.

As shown in FIGS. 3 and 5, an ice mold 230 may be provided within ice making chamber 154 (or, in alternative embodiments, in freezer chamber 124). In particular, ice mold 230 may be removably positioned within ice making chamber 154 such that a user may selectively place ice mold 230 within ice making chamber 154 (e.g., during ice making operations) and remove ice mold 230 from ice making chamber 154 (e.g., to remove ice billets from ice mold 230) as desired. Upon placement of ice mold 230 in ice making chamber 154, ice mold 230 is situated below fluid dispenser 233 such that opening of valve 222 permits the flow of water through fluid dispenser 233 and into ice mold 230.

As shown, ice mold 230 includes one or more sidewalls 232 that define one or more mold cavities 234 in which water may be received and ice cubes or billets may be formed. Optionally, the mold cavities 234 may be defined as open voids in fluid communication with fluid dispenser 233. For instance, the sidewalls 232 may define an opening 240 corresponding to each mold cavity 234 through which air or water may pass. The opening 240 may, for example, have a horizontal diameter that is equal to or greater than the horizontal diameter of the mold cavity 234.

A variety of ice molds may be employed having mold cavities of varying sizes, shapes, and protuberances or recesses on the surface of the mold cavity. The size, shape, and pattern of mold cavity governs the shape of the ice that forms within ice mold 230, enabling users to create an infinite variety of customized ice cubes for use at parties, social events, and the like. In the embodiments of FIGS. 3 and 5, mold cavities 234 are generally spherical in shape. However, an infinite variety of mold cavity shapes and sizes are conceivable. For example, mold cavities may be shaped in the form of letters of the alphabet or numerals. In other embodiments, mold cavities may include indentations shaped in the form of a dog's face. Still other embodiments may consist of a series of lines or curves that form a pleasurable shape. The present invention is not intended to be limited to these shapes or designs, but rather may apply to any customized design.

Each ice mold includes a mold identifier. As shown in the embodiment of FIG. 3, ice mold 230 is equipped with mold identifier 235. Mold identifier 235 is a machine-readable indicator. In some embodiments, mold identifier 235 may take the form of a radio frequency identification (RFID) tag. In other embodiments, mold identifier 235 may be a QR code. In still other embodiments, mold identifier 235 may be a bar code. However, the present invention is not intended to be limited to identification using the exemplary techniques herein disclosed. Rather, those of ordinary skill in the art will recognize that any form of machine-readable identifier will suffice.

Ice making appliance 100 further a mold identifier reader 237, as shown in the embodiment of FIG. 3. Mold identifier reader is used to scan or otherwise detect mold identifier 235. As the skilled artisan will recognize, the nature of mold identifier reader 237 depends on the type of mold identifier 235 employed in the system. For example, where mold identifier 235 is a RFID tag, mold identifier reader 237 includes an RFID scanner. Because RFID tags operate by transmitting radio frequency signals, direct line of sight is not necessary in this embodiment. Rather, in this scenario, mold identifier reader 237 need only be in close proximity (e.g., 2-3 feet) to mold identifier 235 when the system is operational. Thus, mold identifier reader 237 may, but need not, be located within ice making chamber 154 (or, in alternative embodiments, freezer chamber 124), but must simply be located within the proximity range. In alternatives embodiments involving mold identifiers that are QR codes or bar codes, line of sight is necessary. Therefore, in such embodiments, mold identifier reader 237 is located within the chilled chamber in direct view of ice mold 230. As one of ordinary skill in the art will recognize, a mold identifier consisting of a QR code will require a mold identifier reader that is a camera or other optical scanner. Likewise, the skilled artisan will recognize that embodiments of mold identifier 235 that employ a bar code will require that the mold identifier reader 237 is a laser scanner.

In some embodiments, one or more sensors are mounted on or within ice mold 230. As an example, a temperature sensor 244 may be mounted to ice mold 230. Temperature sensor 244 may be electrically coupled to controller 164 and configured to detect the temperature within ice mold 230. Temperature sensor 244 may be formed as any suitable temperature detecting device, such as a thermocouple, thermistor, etc. Optionally, temperature sensor 244 may be mounted at a predetermined height along one of the sidewalls 232. Signals indicative of the current temperature may be sent to a controller 164, described below. Optionally, controller 164 may be configured to adjust one or more operations of the ice making assembly 202 in response to temperature signals from the ice mold 230 as further described below.

In additional or alternative embodiments, a pressure sensor 246 is mounted to ice mold 230. Pressure sensor 146 may be formed as any suitable pressure detecting device, such as a piezoresistive, capacitive, electromagnetic, piezoelectric, or optical pressure detecting device. During use, signals indicative of the pressure at the pressure sensor 246 may be sent to controller 164. Optionally, controller 164 may be configured to adjust one or more operations of the ice making assembly 202 in the pressure signals from the ice mold 230 as further described below.

A user interface panel 160 is provided for controlling the mode of operation. For example, user interface panel 160 may include a plurality of user inputs 162, such as a touchscreen or button interface, for selecting a desired mode of operation. Operation of ice making appliance 100 can be regulated by controller 164 that is operatively coupled to user interface panel 160, valve 222, an external communication network 170, as described herein, temperature sensor 244, pressure sensor 246, or various other components, as described herein. User interface panel 160 provides selections for user manipulation of the operation of ice making appliance 100 such as (e.g., selections regarding chamber temperature, ice making speed, or other various options). In response to user manipulation of user interface panel 160 or one or more sensor signals, controller 164 may operate various components of the ice making appliance 100 or ice making assembly 120.

Controller 164 may include a memory and one or more microprocessors, CPUs, or the like, such as general or special purpose microprocessors operable to execute programming instructions or micro-control code associated with operation of ice making appliance 100. The memory may represent random access memory such as DRAM or read only memory such as ROM or FLASH. In one embodiment, the processor executes programming instructions stored in memory. The memory may be a separate component from the processor or may be included onboard within the processor. Alternatively, controller 164 may be constructed without using a microprocessor (e.g., using a combination of discrete analog or digital logic circuitry, such as switches, amplifiers, integrators, comparators, flip-flops, AND gates, and the like; to perform control functionality instead of relying upon software).

Controller 164 may be positioned in a variety of locations throughout ice making appliance 100. In optional embodiments, controller 164 is located within the user interface panel 160. In other embodiments, the controller 164 may be positioned at any suitable location within ice making appliance 100, such as for example within cabinet 102. Input/output ("I/O") signals may be routed between controller 164 and various operational components of ice making appliance 100. For example, user interface panel 160 may be in communication with controller 164 via one or more signal lines or shared communication busses.

As illustrated, controller 164 may be in communication with the various components of ice making assembly 102 and may control operation of the various components. For example, various valves, switches, etc. may be actuatable based on commands from the controller 164. As discussed, user interface panel 160 may additionally be in communication with the controller 164. Thus, the various operations may occur based on user input or automatically through controller 164 instruction.

In addition, referring to FIG. 4, ice making appliance 100 may generally include an external communication network 170 which is configured for enabling the user to interact with ice making appliance 100, for example, using a remote device 172. Specifically, according to an exemplary embodiment, external communication network 170 is configured for enabling communication between a user, an appliance, and a remote server 174. According to exemplary embodiments, ice making appliance 100 may communicate with a remote device 172 either directly (e.g., through a local area network (LAN), Wi-Fi, Bluetooth, etc.) or indirectly, as well as with a remote server, e.g., to receive requests for information, to provide operational parameters for the appliance, etc.

In general, remote device 172 may be any suitable device for providing and/or receiving communications or commands from a user. In this regard, remote device 172 may include, for example, a personal phone, a tablet, a laptop computer, or another mobile device. In addition, or alternatively, communication between the appliance and the user may be achieved directly through an appliance control panel (e.g., user interface panel 160). In general, external communication network 170 can be any type of communication network. For example, external communication network 170 can include one or more of a wireless networks, a wired network, a personal area network, a local area network, a wide area network, the internet, a cellular network, etc. In general, communication with network may use any of a variety of communication protocols (e.g., TCP/IP, HTTP, SMTP, FTP), encodings or formats (e.g., HTML, XML), and/or protection schemes (e.g., VPN, secure HTTP, SSL).

External communication network 170 is described herein according to an exemplary embodiment of the present subject matter. However, it should be appreciated that the exemplary functions and configurations of external communication network 170 provided herein are used only as examples to facilitate description of aspects of the present subject matter. System configurations may vary, other communication devices may be used to communicate directly or indirectly with one or more appliances, other communication protocols and steps may be implemented, etc. These variations and modifications are contemplated as within the scope of the present subject matter.

Figure 6:
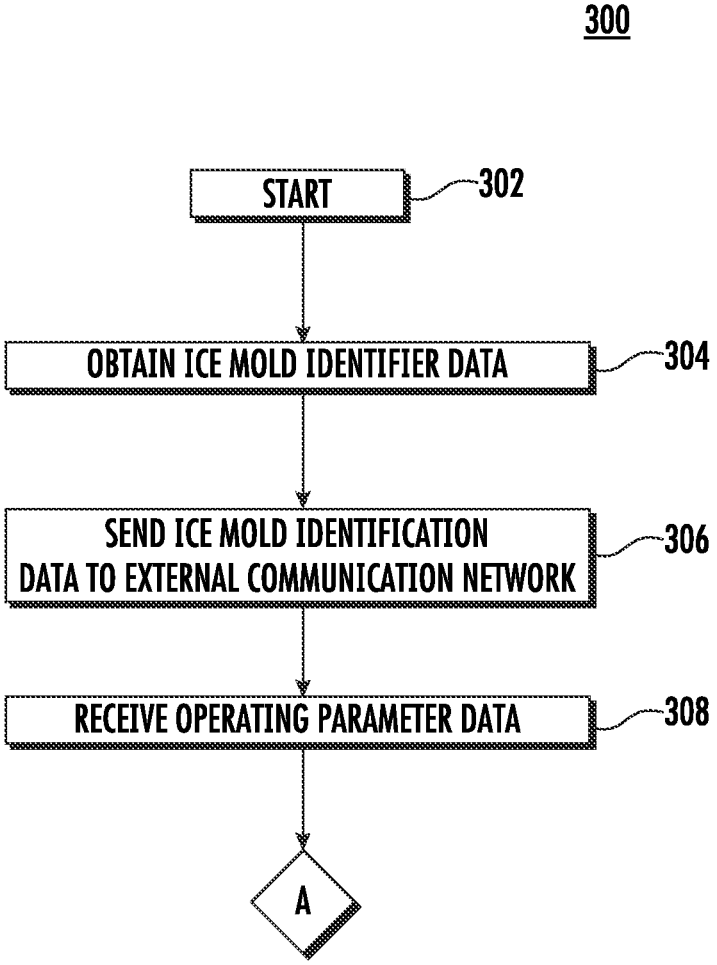
FIG. 6 provides a flow chart illustrating portions of a method of making ice using a custom ice mold having a mold identifier in accordance with an exemplary embodiment of the present disclosure.
Figure 7:
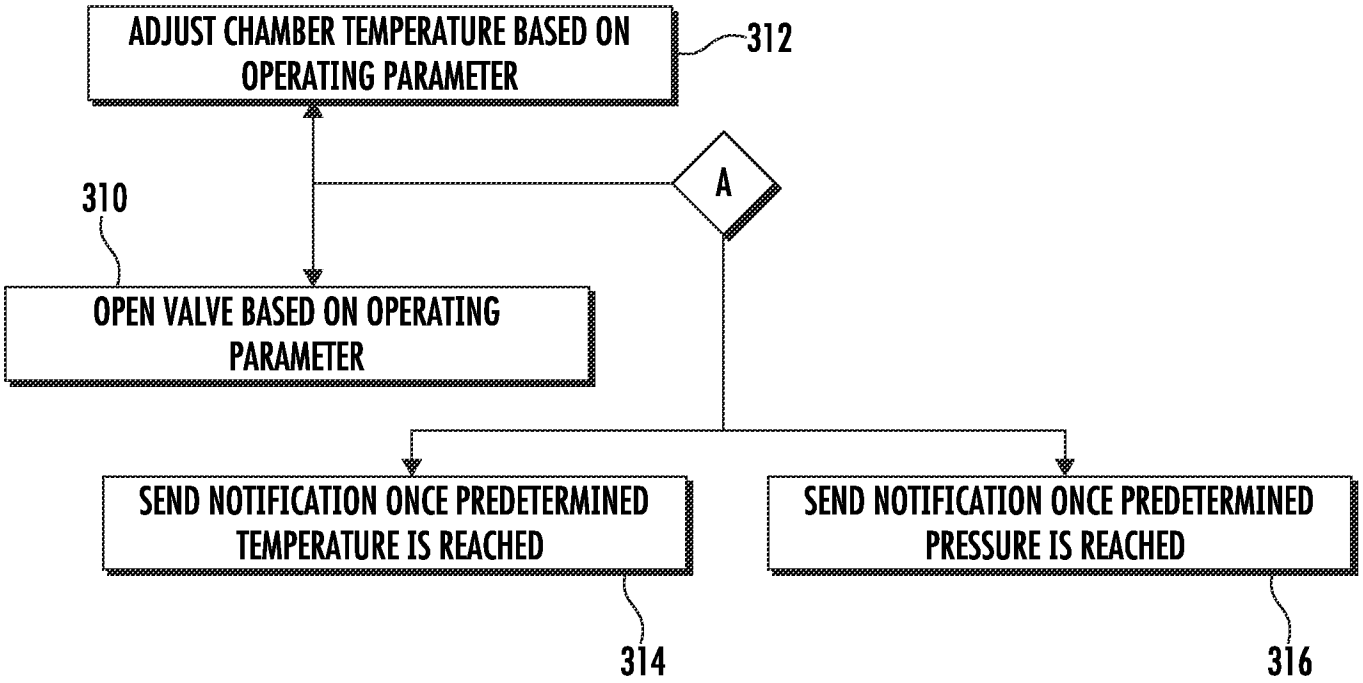
FIG. 7 provides a flow chart illustrating further portions of a method of making ice using a custom ice mold having a mold identifier in accordance with an exemplary embodiment of the present disclosure.

In particular, controller 164 may be operably coupled to valve 222, mold identifier reader 237, and external communication network system 170 to perform a variety of operations. In one embodiment, controller 164 may be used to perform method 300, as shown in FIGS. 6 and 7. FIGS. 6 and 7 depict steps performed in a particular order for purpose of illustration and discussion. Those of ordinary skill in the art, using the disclosures provided herein, will understand that (except as otherwise indicated) the steps of any of the methods disclosed herein can be modified, adapted, rearranged, omitted, or expanded in various ways without deviating from the scope of the present disclosure.

Exemplary method 300 starts at step 302 once the ice mold is placed within the chilled chamber. At step 304 of method 300, ice mold identifier data is obtained. In some embodiments, ice mold reader 237 scans or otherwise detects mold identifier 235. Ice mold identifier data may thus be obtained by ice mold reader 237 and may be provided to controller 164. Ice mold identifier data may take on various forms, but at a minimum, ice mold identifier data is any information that may be used to distinguish the type of ice mold being read from other ice molds that could be used. As an example, an ice mold having cavities shaped for the making of spherical ice cubes would provide different ice mold identifier data than an ice mold having cavities for making A-shaped ice. This ice mold identifier data can then be used to acquire operational details specific to the identified ice mold, as further described herein. It should be noted, however, that different ice molds of the same type (i.e., having the same shape and dimensions) may share ice mold identifier data in some cases. That is, different ice molds of the same type need not have unique ice mold identifier data from each other, although they may in some embodiments.

At step 306 of exemplary method 300, ice mold identification data is sent to an external communication network. In some embodiments, ice mold identification data may be identical to ice mold identifier data and may be simply passed through. In alternative embodiments, ice mold identification data may differ from ice mold identifier data. But like the ice mold identifier data, ice mold identification data distinguishes between different mold types. As previously noted, external communication network 170 may be a local or remote network.

In some embodiments, a remote server 174 may also be connected to external communication network 170 and may receive the mold identification data. The remote server 174 may include local memory or may access a database or other data source through external communication network 170 or through a separate network. Remote server 174 may access operating parameter data that correlates with the mold identification data. Alternatively, or additionally, external communication network 170 may be connected to a remote device 172, such as a smart phone, tablet, laptop, desktop computer, or the like. In one embodiment, remote device 172 may access operating parameter data through a local or remote data source via external communication network 170 or via some other network. In other embodiments, operating parameter data may be stored locally on remote device 172. In still further embodiments, remote device 172 may access operating parameter data through remote server 174.

Operating parameter data may include one or more of the volume of water required to fill the ice mold type associated with the mold identification data, the predetermined temperature at which ice formation is complete for such ice mold type, or the predetermined pressure at which ice formation is complete for such ice mold type. Although exemplary types of operation parameter data are provided herein, the present disclosure is not intended to be limited to these specific parameters. Indeed, any information relating to the operation of the ice making appliance for use with the identified ice mold would suffice.

At step 308, the operating parameter data is received from the external communication network representing at least one operating parameter for use with the ice mold. FIG. 7 illustrates how operating parameter data may be used according to the exemplary method 300. For example, at step 310, exemplary method 300 opens a valve based on the operating parameter data. In this step, the operating parameter data is the volume of water to be dispensed. The duration of the valve opening may be based, in some embodiments, on a fixed period of time which correlates to the volume of water passing through the valve during that period of time. In such embodiments the fixed period of time would be adjusted based on the predetermined volume of water needed for the particular ice mold in use, as set for in the operating parameter data. Additionally, or alternatively, some embodiments may employ a volumetric flow sensor (not shown) to determine the volume of water passing through the valve, closing the valve once the volume of water detected matches the predetermined volume of water needed for the ice mold in use, as determined based on the operating parameter data.

At step 310, exemplary method 300 adjusts the temperature of the chilled chamber based on the operating parameter data. Different chamber temperatures may be beneficial in the formation of ice for different ice molds having different characteristics (e.g., different volumes, thicknesses, or finer details). The desired ice formed in the ice molds may therefore require more time to form or may have a different appearance if frozen at one temperature versus another. Therefore, as shown in step 312, the temperature of the chamber may constitute operating parameter data used to adjust the chamber temperature for optimal conditions associated with the particular ice mold in use.

Another use of operating parameter data, as shown in exemplary method 300 at step 314, is to send a notification to the external communication network based on the ice mold reaching a predetermined temperature at which ice formation is complete. As explained herein, ice mold 320 may include a temperature sensor 244 in certain embodiments. In alternative embodiments, temperature sensor 244 may be situated elsewhere in the chilled chamber in which the ice mold resides. The temperature sensor will read different temperatures, for example, immediately after introduction of water into the ice mold and, for example, after the water has frozen. The operating parameter data may include a predetermined temperature at which the formation of ice is complete, which may vary depending on the ice mold used and its particular characteristics. Upon reading the predetermined temperature, a notification may be sent to the external communication network indicating that the ice is ready to harvest. In some embodiments, the notification may be forwarded to a user's mobile device, for example, to provide such alert.

Similarly, at step 316 of exemplary method 300, a notification is sent to the external communication network based on the ice mold reaching a predetermined pressure at which ice formation is complete. As explained herein, ice mold 320 may include a pressure sensor 246. Pressure sensor 246 measures the pressure exerted on sidewalls 232 that define one or more mold cavities 234. The pressure exerted, for example, by liquid water newly added to the mold cavities differs from the pressure exerted by frozen ice. The operating parameter data may include a predetermined pressure at which the formation of ice is complete, which may vary depending on the ice mold used and its particular characteristics. Upon reading the predetermined pressure, a notification may be sent to the external communication network indicating that the ice is ready to harvest. In some embodiments, the notification may be forwarded to a user's mobile device, for example, to provide such alert.

Although exemplary method 300 provides for a variety of uses of operating parameter data, these uses are merely exemplary. In some embodiments, different combinations of the identified uses may be employed or none at all. Nor are the uses disclosed as part of method 300 intended to be limiting. Additional uses of operating parameter data are intended to fall within the scope of the present disclosure as would be apparent to one of ordinary skill in the art.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making appliance comprising:
- a cabinet;
- a chilled chamber within the cabinet, the chilled chamber further including a fluid dispenser;
- a removable ice mold situated below the fluid dispenser and further including a mold identifier;
- a mold identifier reader;
- a controller operably coupled to the mold identifier reader and an external communication network including a remote server, the controller configured to:
  - obtain ice mold identifier data from the mold identifier reader;
  - receive operating parameter data from the remote server representing at least one operating parameter for use with the ice mold; and
  - use the at least one operating parameter obtained from the remote server to control operation of the ice making appliance.

2. The ice making appliance of claim 1, wherein the controller is further configured to send ice mold identification data to the remote server, the ice mold identification data being based on the ice mold identifier data.

3. The ice making appliance of claim 2, wherein the controller is further configured to receive operating parameter data from the remote server representing at least one operating parameter based on the ice mold identification data.

4. The ice making appliance of claim 1, wherein the at least one operating parameter includes a predetermined fluid volume to fill the ice mold.

5. The ice making appliance of claim 1, wherein the ice mold further comprises a temperature sensor.

6. The ice making appliance of claim 5, wherein the at least one operating parameter includes a predetermined temperature at which ice formation is complete.

7. The ice making appliance of claim 6, wherein the controller is operably coupled to the temperature sensor and is further configured to send a notification to the remote server of the external communication network based on the temperature sensor reaching the predetermined temperature at which ice formation is complete.

8. The ice making appliance of claim 1, wherein the ice mold further comprises a pressure sensor and wherein the at least one operating parameter includes a predetermined pressure at which ice formation is complete.

9. The ice making appliance of claim 8, wherein the controller is operably coupled to the pressure sensor and is further configured to send a notification to the remote server of the external communication network based on the pressure sensor reaching the predetermined pressure at which ice formation is complete.

10. The ice making appliance of claim 1, the ice making appliance further comprises a valve in fluid communication with the fluid dispenser for controlling the flow of water to the fluid dispenser, wherein the controller is operably coupled to the valve and using the at least one operating parameter obtained from the remote server to control operation of the ice making appliance includes using the at least one operating parameter to control operation of the valve.

11. A method of making ice using a custom ice mold having a mold identifier, the method comprising:
- obtaining ice mold identifier data from the ice mold;
- receiving operating parameter data from a remote server of an external communication network representing at least one operating parameter for use with the ice mold; and
- using the at least one operating parameter obtained from the external communication network to control operation of a valve.

12. The method of claim 11, the method further comprising sending ice mold identification data to the remote server of the external communication network, the ice mold identification data being based on the ice mold identifier data.

13. The method of claim 12, the method further comprising receiving operating parameter data from the remote server of the external communication network representing at least one operating parameter based on the ice mold identification data.

14. The method of claim 11, wherein the at least one operating parameter includes a predetermined fluid volume of water to fill the ice mold.

15. The method of claim 14, wherein using the at least one operating parameter obtained from the remote server of the external communication network to control operation of a valve further comprises opening the valve until the predetermined volume of water to fill the ice mold is dispensed into the ice mold.

16. The method of claim 11, wherein the at least one operating parameter includes a predetermined temperature at which ice formation is complete.

17. The method of claim 16, the method further comprising sending a notification to the remote server of the external communication network based on the ice mold reaching the predetermined temperature at which ice formation is complete.

18. The method of claim 11, wherein the at least one operating parameter includes a predetermined pressure at which ice formation is complete.

19. The method of claim 18, the method further comprising sending a notification to the remote server of the external communication network based on reaching the predetermined pressure at which ice formation is complete.

20. The method of claim 11, the method further comprising using the at least one operating parameter obtained from the remote server of the external communication network to control the temperature of a chamber in which the ice mold is situated.

* * * * *